United States Patent [19]

Marlowe

[11] Patent Number: 4,887,394

[45] Date of Patent: Dec. 19, 1989

[54] ADJUSTMENT APPARATUS FOR SUPPORTING A SLIDABLE DOOR

[75] Inventor: James L. Marlowe, Union City, Tenn.

[73] Assignee: Sterling Plumbing Group, Inc., Schaumberg, Ill.

[21] Appl. No.: 342,115

[22] Filed: Apr. 24, 1989

[51] Int. Cl.[4] ..... E05D 15/06

[52] U.S. Cl. ..... 49/409; 49/425; 16/105

[58] Field of Search ..... 49/409, 425, 231; 16/105, 106, 97

[56] References Cited

U.S. PATENT DOCUMENTS

| | | | |
|---|---|---|---|
| 1,792,568 | 2/1931 | Boedtcher | 16/106 |
| 2,963,753 | 12/1960 | Seaburg | 49/409 |
| 3,037,555 | 6/1962 | Kochanowski . | |
| 3,058,173 | 10/1962 | Brydolf . | |
| 3,102,581 | 9/1963 | Kochanowski . | |
| 3,111,209 | 11/1963 | Riegelman . | |
| 3,441,076 | 4/1969 | Glejf et al. . | |
| 3,696,560 | 10/1972 | Hallin | 16/105 |
| 4,014,377 | 3/1977 | Kochanowski . | |
| 4,014,378 | 3/1977 | Kochanowski . | |
| 4,077,160 | 3/1978 | Stewart | 16/105 |
| 4,104,829 | 8/1978 | Agcaoili . | |
| 4,375,736 | 3/1983 | Teckchandani . | |
| 4,388,778 | 6/1983 | Brooke . | |
| 4,453,346 | 6/1984 | Powell et al. . | |
| 4,633,614 | 1/1987 | Van Weelden . | |
| 4,653,127 | 3/1987 | Baus . | |
| 4,769,949 | 9/1988 | Glendowne . | |

*Primary Examiner*—Kenneth J. Dorner
*Assistant Examiner*—Gerald A. Anderson
*Attorney, Agent, or Firm*—Quarles & Brady

[57] ABSTRACT

An adjustment apparatus for supporting a slidable door is disclosed that has a bar-like pivotable frame member. A pair of track followers, such as rollers, are mounted adjacent the ends of the frame member. A door has upper and lower edges, and opposite side edges. The upper door edge is pivotally connected to a central portion of the pivot frame member. A pair of stems are pivotally fastened to the frame member adjacent the ends of the frame member. Each stem is also mounted in a sliding relationship with respect to the side edges of the door. In this way, the frame member can pivot with respect to the upper door edge. When installing the slidable door, this pivot action allows the door to be flush against the frame structure, even though the wall or frame may be out-of-plumb. Final adjustment of the apparatus simply requires tightly fastening a central bolt and at least one screw.

5 Claims, 3 Drawing Sheets

ADJUSTMENT APPARATUS FOR SUPPORTING A SLIDABLE DOOR

BACKGROUND OF THE INVENTION

The present invention relates to structures for supporting slidable doors (e.g., shower or closet doors). More particularly, it pertains to an apparatus that can be easily adjusted to change the angle at which a slidable door is mounted, thereby compensating for an out-of-plumb wall.

A slidable door generally incorporates a track system at its top for suspending the door. The method of suspension usually involves hangers and guides. The hangers have one end attached to the door and the other end connected to a guide. The guides, frequently in the form of rollers, move along horizontal top tracks so as to permit the door to slide along the track.

One problem with using slidable doors is that the surrounding walls are often out-of-plumb. When a slidable door is positioned against an out-of-plumb wall, either the top or bottom portion of the door fits snugly against the wall, while the other portion gaps away from the wall. For a slidable door in an entranceway, this will allow drafts to pass by the door. Likewise, an improperly aligned slidable door on a shower or other bathing enclosure may permit water to leak from the bathing area. Out of plubm walls can also make it difficult to move the rollers on the tracks when the doors moved.

Various types of slidable door structures have been used to compensate for out-of-plumb walls or support structures. See. e.g., U.S. Pat. Nos. 4,104,829 and 4,633,614. For these systems, adjustment is difficult and/or the door must be removed from its track to re-position the rollers, and/or the parts involved are difficult and expensive to make.

Thus, it can be seen that an improved apparatus is needed which can support a slidable door and be easily adjusted to compensate for an out-of-plumb wall structure.

SUMMARY OF THE INVENTION

This invention provides an adjustment apparatus for supporting a slidable door. A bar-like pivotable frame member has a pair of track followers mounted on it. Also there are a pair of stems, at least one of which is pivotally fastened to the frame member. A door has upper and lower door edges and opposite side edges. Either the upper door edge or the lower door edge is pivotally mounted to a central region of the frame member. The stems are in a sliding relationship with respect to the side edges, and at least one of the stems is attached to a side edge. In this way, the frame member can pivot with respect to the door, thereby positioning one or both stems relative to the side edges.

This aspect of the invention provides an apparatus that can be easily adjusted to accommodate for an out-of-plumb wall structure. The pivoting relationship between the frame member and the door provides an apparatus that will produce precise alignment of the door with respect to the out-of-plumb structure.

Thus, it is a principal object of the present invention to provide a system which will allow sliding doors to be properly positioned to compensate for an out-of-plumb wall.

It is another object of the invention to provide an apparatus for a slidable door that can be adjusted without having to remove the door from the track.

It is yet another object of the invention to provide an apparatus that can be adjusted without having to manually raise or lower the door in order to determine the proper position of the door, so as to eliminate the need for judgements on the part of the installer.

It is still another object of the invention to provide an adjustment apparatus for slidable doors that is structurally and operationally uncomplicated, in order to minimize manufacturing costs and reduce installation time and effort.

The foregoing and other objects and advantages of the invention will be evident from the following description. In the description, reference is made to the accompanying drawings which form a part hereof, and in which there is shown by way of illustration a preferred embodiment of the invention. Such embodiment does not necessarily represent the full scope of the invention. Reference is therefore made to the claims herein for interpreting the scope of the invention.

DETAILED DESCRIPTION OF THE PREFERRED EMBODIMENT

Figure 1:
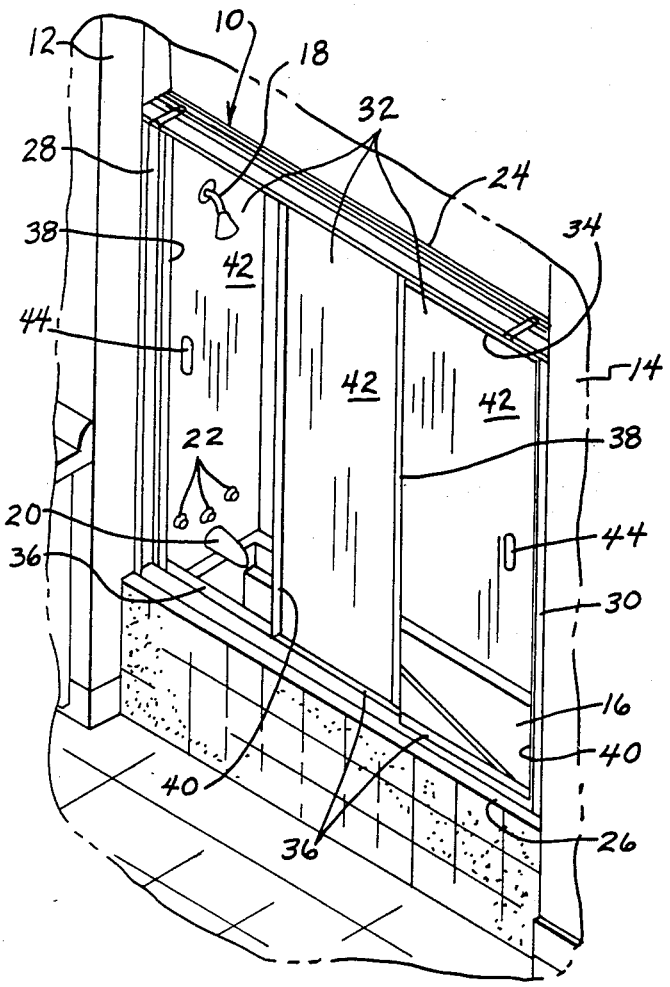
FIG. 1 is a view in perspective of a bathing enclosure provided with slidable doors according to the invention.

Referring to the drawings, a bathing enclosure 10 is shown in FIG. 1 positioned between two walls 12 and 14. The bathing enclosure 10 is in the form of a bath-shower combination having a bathtub 16, a shower head 18, a faucet 20, and various water controls 22. The bathing enclosure 10 employs a support structure with a header 24 positioned between the walls 12 and 14. Adjacent the bathtub 16 is a sill track 26 which also extends between the two walls 12 and 14. End jambs 28 and 30 extend vertically between the header 24 and the sill track 26, along the walls 12 and 14.

Three doors 32 are shown as part of the bathing enclosure 10. Each door 32 has an upper door edge 34 (not shown on all doors), a lower edge 36, and a pair of side edges 38 and 40. In this illustration, each door 32 has a panel 42 housed within the upper and lower door edges 34 and 36 and the side edges 38 and 40. The left and right doors are shown with handles 44 formed in the panels 42. Such a panel 42 can be made from glass or plastic depending on its intended use, and can be translucent as shown by the center door. Caulking (not shown) may be applied between the panel 42 and the door edges to provide a watertight seal.

Figure 2:
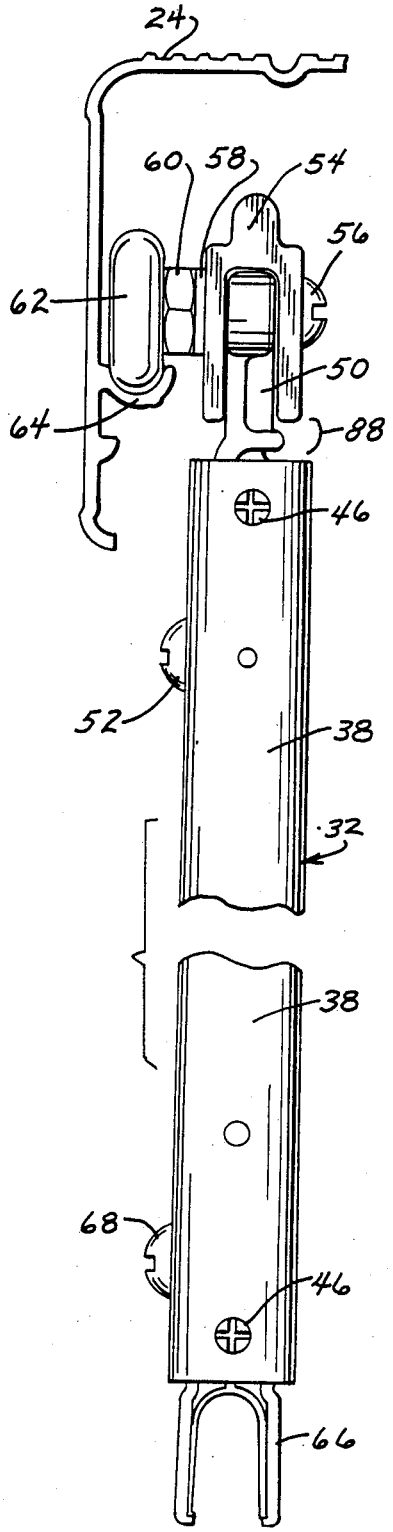
FIG. 2 is a fragmented view, taken from the side, of the top and bottom portion of one of the slidable doors shown in FIG. 1.
Figure 4:
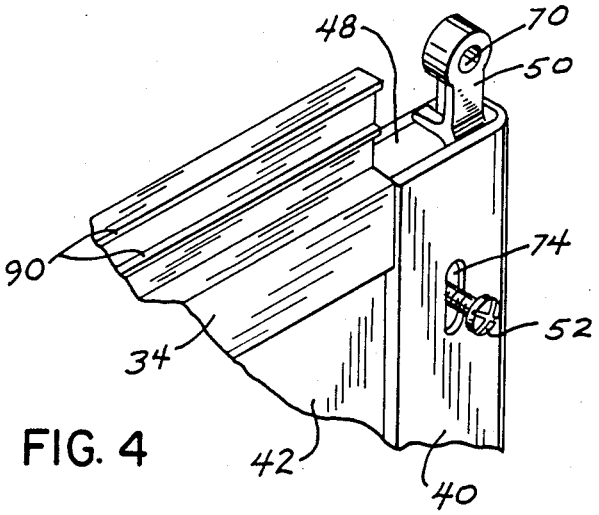
FIG. 4 is a partial view in perspective of the same components as shown on the apparatus in FIG. 3 in assembled form.
Figure 3:
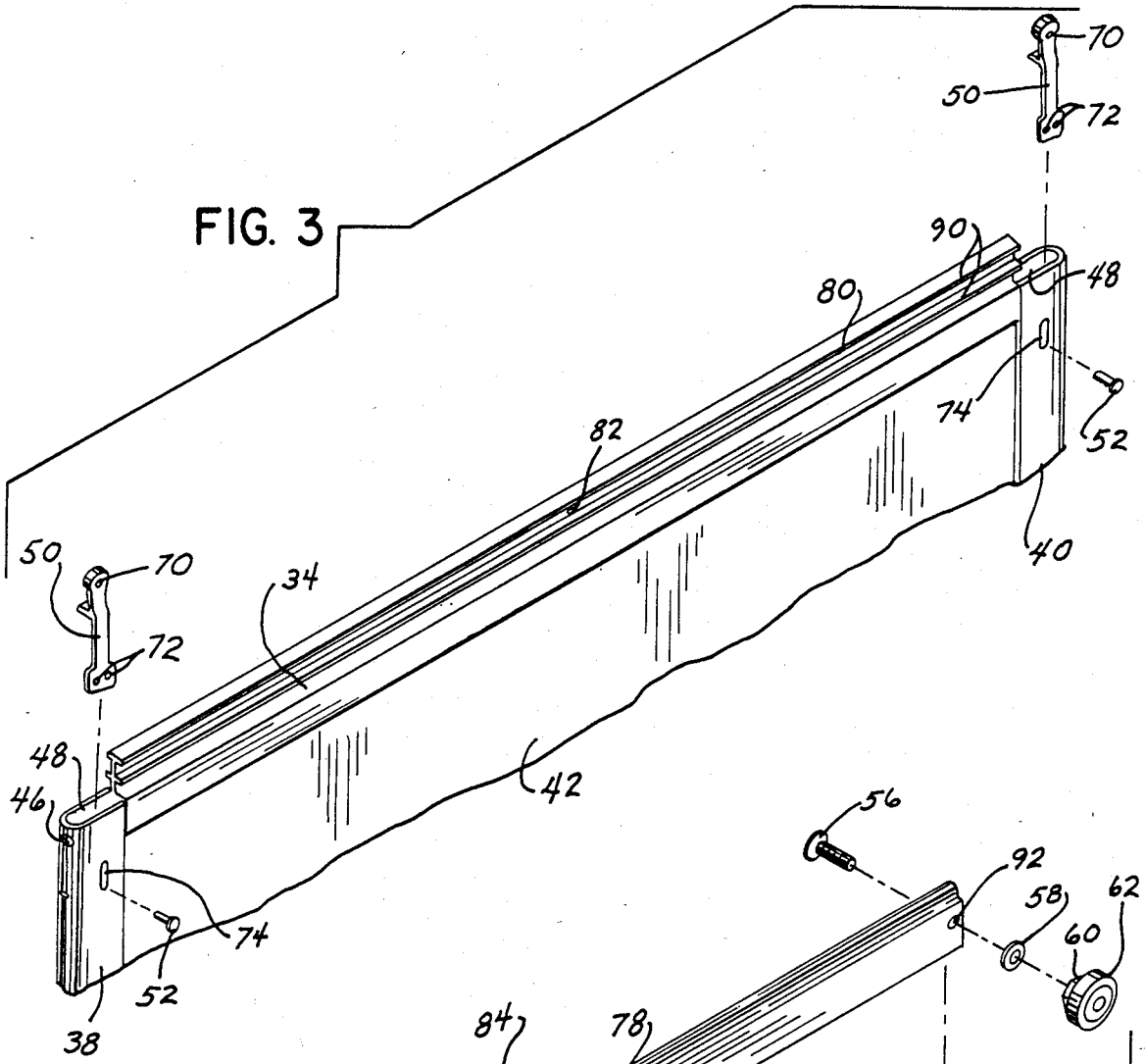
FIG. 3 is an exploded view in perspective of several components of the adjustment apparatus according to the inention.
Figure 5:
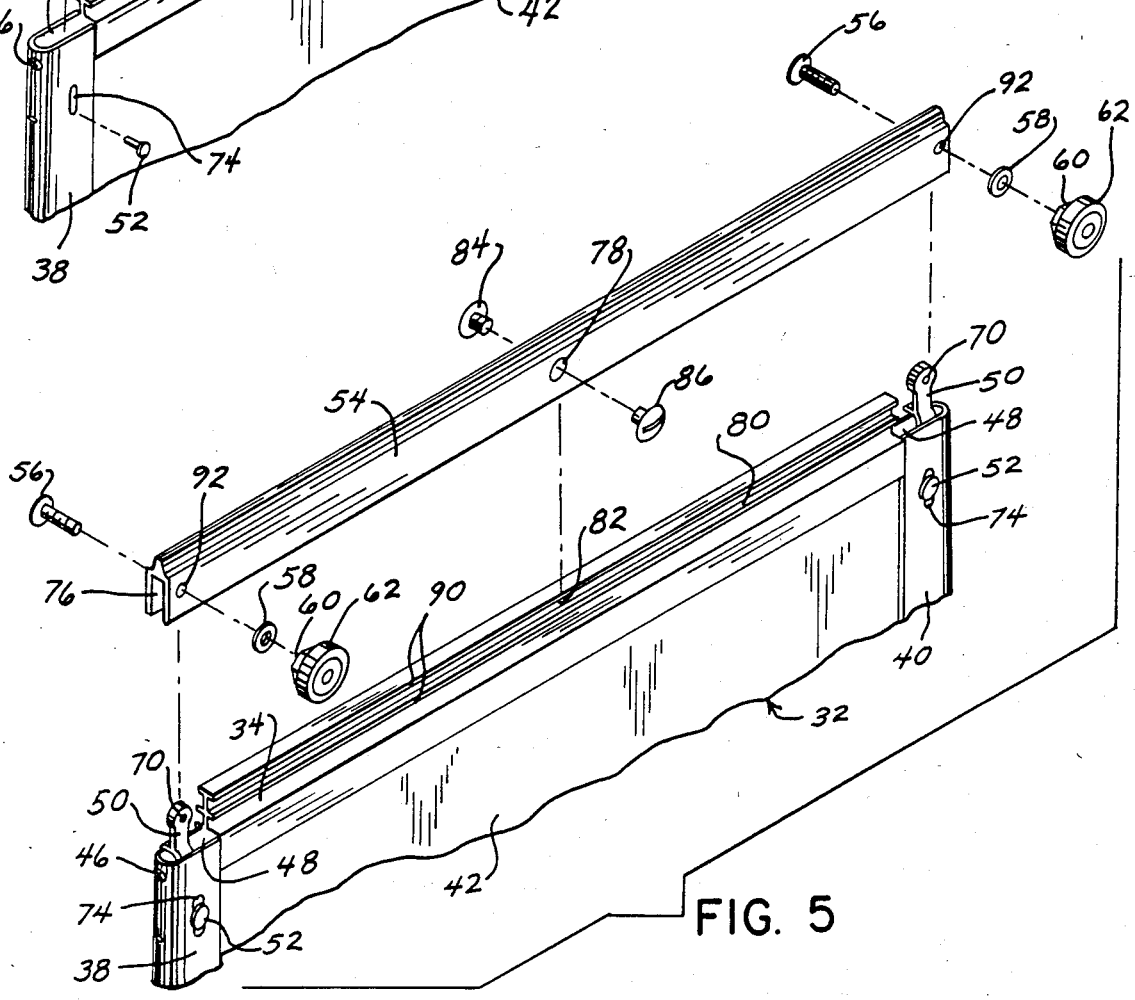
FIG. 5 is an exploded view in perspective of the adjustment apparatus according to the invention.

Each door 32 is designed to slide along the header 24 and the sill track 26, as shown by the completely assembled and installed door 32 in FIG. 2. Screws 46 are used to fasten the side edge 38 to the upper and lower door edges 34 and 36 (not shown in FIG. 2). Both side edges 38 and 40 are formed with an internal vertically extending bore 48 (FIGS. 3, 4 and 5).

In accordance with the invention, the door 32 is suspended from the header 24 by the use of a stem 50, which partially resides within the internal bore 48 and partially extends above the top of the door 32. The stem 50 is fastened to the side edge 38 of the door 32 by an adjustment screw 52. The other end of the stem 50 is pivotally secured to a bar-like pivot member 54 by a bolt 56.

The frame member 54 has a U-shaped cross section wherein one end of the stem 50 resides. The bolt 56 extends through a washer 58, and is attached to a nut 60. The nut 60 is connected to a track follower 62 so that the track follower 62 is rotatable with respect to the bolt 56. The track follower 62 is shaped to reside within a rail 64 formed integrally with the header 24. In this way, the track follower 62 is free to slide along the rail 64 which extends the length of the header 24.

The bottom of the door 32 is engaged with the sill track 26 (FIG. 1) in order to prevent the door 32 from swinging out of its normal vertical position. A guide 66 (FIG. 2) is designed to be freely positioned over a runner (not shown) in the sill track 26 (FIG. 1). The guide 66 inserts into the internal bore 48 of the side edge 38 and is secured by a screw 68. The runner extends the length of the sill track 26. The door 32 is thus free to slide lengthwise along the header 24 and sill track 26, but is prevented by interaction of the guide 66 and runner from swaying out of a vertical position.

Several components of the adjustment apparatus are shown in FIG. 3 during an assembly stage. The two stems 50 each have an aperture 70 at one end and two screw holes 72 at the other end. The stems 50 are shaped such that the end having the two screw holes 72 is positionable within the internal bore 48 of the side edges 38 and 40. The adjustment screws 52 are then positioned through elongated slots 74 in the side edges 38 and 40 and inserted into one of the two screw holes 72 in the stems 50.

The assembly to this point is illustrated in FIG. 4. The adjustment screw 52 is not yet completely tightened. This permits the adjustment screw 52, and thus the stem 50, to slide over the length of the elongated slot 74. Additionally, at this point in the assembly, the stem 50 can rotate about an axis defined by the adjustment screw 52. Rotation is constrained only by the side edge 40 and the upper door edge 34.

The next step in assembling the adjustment apparatus is illustrated in FIG. 5. The bar-like pivotable frame member 54 extends approximately the width of the door 32. The U-shaped cross section of the frame member 54 forms a channel 76 that extends the length of the frame member 54. A pivot aperture 78 is located in a central region of the pivot frame member 54. The aperture 78 actually consisting of two holes on each side of the channel 76.

The upper door edge 34 has a web portion 80 that extends above the side edges 38 and 40. Within the web portion 80 is an aperture 82 in a location that corresponds to the location of the pivot aperture 78 in the frame member 54. The web portion 80 is designed so that it can resides inside channel 76 of the pivot frame member 54. A bolt 84 and a blind nut 86 extend through apertures 82 and 78 to pivotally mount the frame member 54 to the upper door edge 34. Pivoting is possible due to the presence of a gap 88 (FIGS. 2 and 7) between the pivot frame member 54 and the tops of the side edges 38 and 40. The bolt 84 and the blind nut 86 are shown for the purposes of illustration only. Other systems may be used to provide a pivotable mounting, such as a nut and bolt, a pin, or a flange and peg formed integrally with the frame member 54 and the web portion 80.

Two flanges 90, having a width slightly less than the width of the channel 76, are formed in the web portion 80. The flanges 90 add to the sturdiness of the assembled door 32 by minimizing movement (other than the pivoting movement just described) between the frame member 54 and the upper door edge 34.

Adjacent each end of the pivotable frame member 54 are holes 92. The bolts 56 extend through each hole 92, and are inserted through apertures 70 of the stems 50. The bolts 56 also pass through the washers 58, and are threadably engaged in the nuts 60, which are connected to the track followers 62. The track followers 62 (shown in FIG. 5) are in the form of rollers. Other track followers such as glides may be used, provided the track followers 62 are free to move along the header 24. The bolts 56 and the track followers 62 are designed to be secured together while still permitting the track followers 62 to roll or glide on the rail 64 (FIG. 2).

Figure 6:
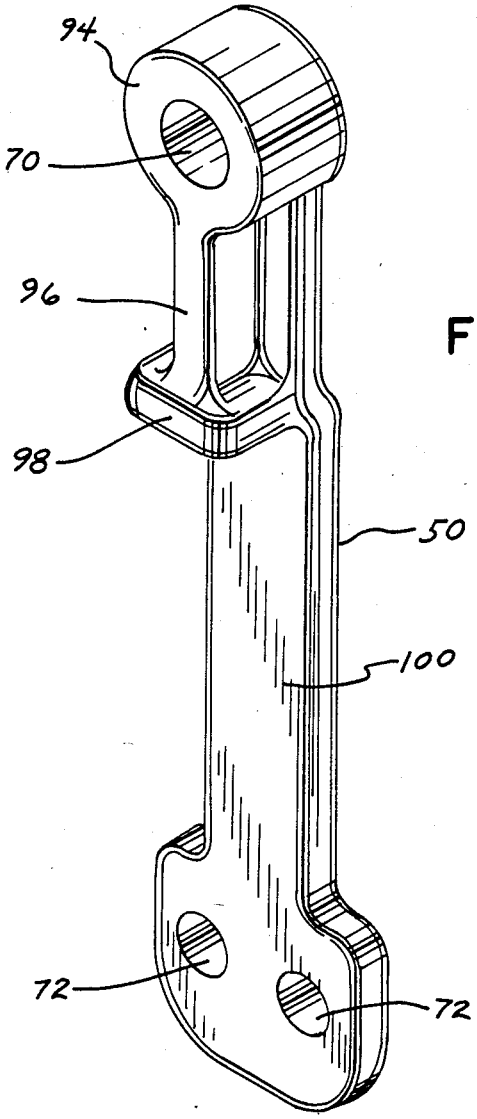
FIG. 6 is an enlarged view in perspective of a stem component of the adjustment apparatus.

An enlarged stem 50 is shown in FIG. 6. Stem 50 has a ring portion 94 surrounding aperture 70, and a leg portion 96 that extends down to a flange 98. The width of the ring and leg portion 94 and 96 is such that the stem 50 can reside within channel 76 of the frame member 54. When bolts 56 are inserted through aperture 70 and tightened, the frame member 54 is drawn against the ring and leg portions 94 and 96 to provide a sturdy construction. Stem 50 also has an body portion 100 that extends between the flange 98 and the screw openings 72.

The body portion 100 is aligned off-center with respect to the ring and leg portions 94 and 96. This allows the body portion 100 to fit into the internal bore 48 between the side edges 38 and 40 and the screws 46 that connect the side edges 38 and 40 to the upper and lower edges 34 and 36 (best illustrated by FIG. 3). When the stem 50 is inserted into the internal bore 48, the screw hole 72 adjacent the panel 42 is aligned with the elongated slot 74. The stem 50 is designed with two holes 72 so that any stem 50 may be used in either of the side edges 38 and 40. Lastly with regard to FIG. 6, note that the width of flange 98 is made greater than the width of the internal bore 48. This prevents the stem 50 from falling completely into the internal bore 48.

Figure 7:
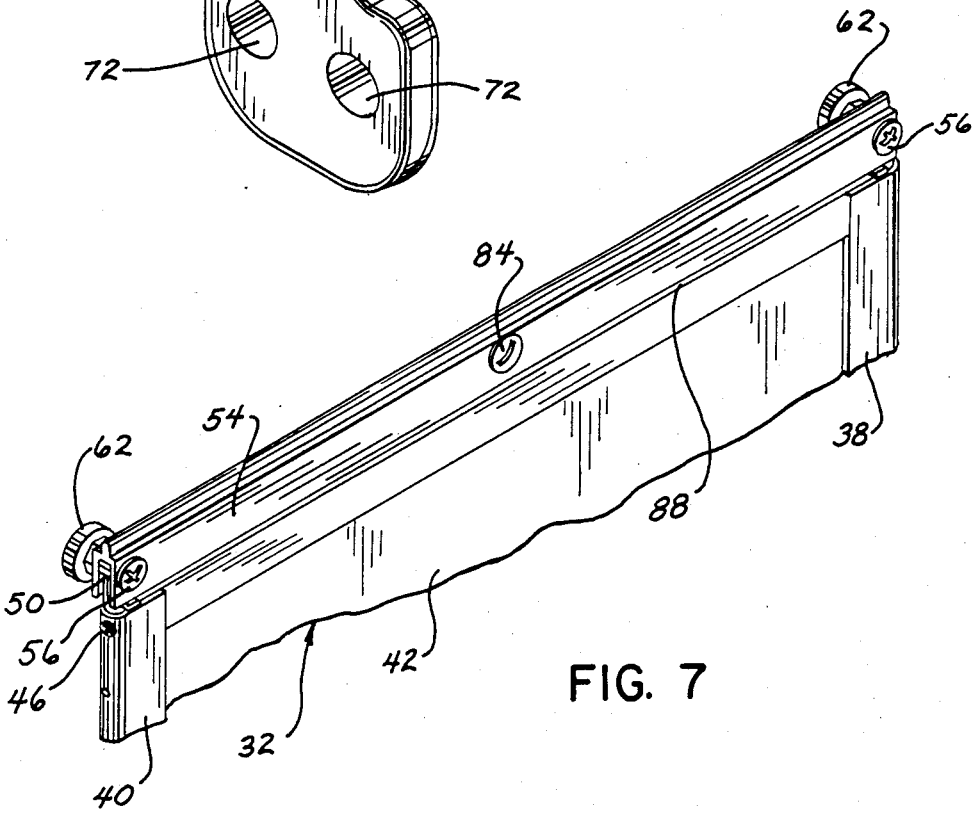
FIG. 7 is a view in perspective of a fully assembled adjustment apparatus according to the present invention.

FIG. 7 shows a completely assembled adjustment apparatus that is ready for installation. For the purpose of illustration, the reverse side of the door 32 is shown, as compared to FIGS. 3, 4 and 5. At this point, the frame member 54 is pivotally connected to the door 32 due to the use of bolt 84 and the existence of the gap 88 (FIGS. 2 and 7). The frame member 54 pivots about an axis through bolt 84. Similarly, the stems 50 are attached to the frame member 54 by the bolts 56 which allow the stems 50 to pivot slightly about an axis through the bolts 56. The other end of the stems 50 are in a sliding relationship with respect to the side edges 38 and 40. As the frame member 54 pivots, the stems 50 slide to the extent that the adjustment screws 52 (FIGS. 3, 4 and 5) can move within the elongated slots 74. Therefore, prior to final installation, the screws 52 are not drawn tight, and the frame member 54 can pivot about an axis passing through bolt 84.

The adjustment apparatus shown in FIG. 7 is ready for final installation. It can be seen at this point that the adjustment apparatus described can easily be modified to operate at the bottom of the door 32, instead of at the top of the door 32. The frame member 54 can pivot with respect to the upper and lower door edges 34 and 36 equally well if it is located at the bottom of the door 32. Proper alignment of the door 32 in relation to an out-of-plumb wall or support structure can be achieved in either case.

The assembled door 32 shown in FIG. 7 is installed in the bathing enclosure 10 (FIG. 1) so that the track followers 62 are positioned in the appropriate rails 64 (FIG. 2). Additionally, the bottom of the door 32 is positioned so that the guide 66 is located over a runner (not shown) in the sill track 26 (FIG. 1). The door 32 can then be easily adjusted to accommodate for an out-of-plumb wall structure or end jamb 28 and 30. Initially, the door 32 should be slid against its adjacent end jamb 28 and 30.

Using the left door in FIG. 1 as an example, if the end jamb 28 is out-of-plumb, the top of side edge 38 will contact the end jamb 28 before the bottom, or vice versa. The door 32 will become flush with the end jamb 28 by gently pushing against the center of the side edge 40 opposite the wall jamb 28. Because the door 32 is free to pivot in relation to frame member 54, the door 32 will easily position itself flush against the end jamb 28. The person installing the slidable door 32 need only tighten one of the screws 52 to fix the door 32 in proper flush position with the end jamb 28. The second screw 52 may be tightened for additional support. By installing the right door 32 against the opposite end jamb 30 in a like manner, both doors 32 will be properly aligned to prevent water from escaping from the bathing enclosure 10.

The foregoing detailed description has been for the purpose of illustration. Thus, a number of modifications and changes may be made without departing from the spirit and scope of the present invention. The example, the pivotable frame member 54 could be made withou a U-shaped cross section. The stems 50 could then be attached to an exterior surface of the frame member 54. Also, the side edges 38 and 40 could be formed without an internal vertically extending bore 48, and the stems 50 could in a same way attach to an exterior surface of the side edges 38 and 40. Likewise, the elongated slots 74 could be provided on the pivotable frame member 54, instead of on the side edges 38 and 40. Therefore, the invention should not be limited by the specific embodiments described, but only by the claims.

I claim:

1. An adjustment apparatus for supporting a slidable door, comprising:
- a bar-like pivotable frame member;
- a pair of track followers mounted on the frame member;
- a pair of stems, at least one of said stems being pivotally fastened to said frame member;
- a door having upper and lower door edges and opposite side edges;
- means for pivotally mounting the frame member to said upper door edge or said lower door edge;
- means for mounting said stems in a sliding relationship with respect to said side edges; and
- means for attaching at least one of said stems to one of said side edges;
- whereby said frame member can pivot with respect to said door and thereby position said one stem relative to said one side edge.

2. The adjustment apparatus of claim 1, wherein the frame member is in the shape of a bar having a U-shaped cross section.

3. The adjustment apparatus of claim 2, wherein each stem has a hole which can be aligned with a corresponding hole on a side edge of the door, and fasteners are provided that can project through said holes to fix the stems in place relative to the side edges.

4. The adjustment apparatus of claim 1, wherein each side edge is formed with an internal substantially vertical bore in which a stem is received.

5. The adjustment apparatus of claim 1, wherein the means for pivotally mounting the frame member comprises a bolt extending substantially horizontally between the frame member and said door.

* * * * *